US005343591A

United States Patent [19]

Clark

[11] Patent Number: 5,343,591

[45] Date of Patent: Sep. 6, 1994

[54] WASHING APPARATUS FOR WALLS AND OTHER NON-HORIZONTAL SURFACES

[76] Inventor: Lloyd T. Clark, 1913 Ruth St., Arlington, Tex. 76010

[21] Appl. No.: 927,958

[22] Filed: Aug. 11, 1992

[51] Int. Cl.[5] ..... A47L 7/00

[52] U.S. Cl. ..... 15/322; 15/321; 15/410

[58] Field of Search ..... 15/321, 322, 410

[56] References Cited

U.S. PATENT DOCUMENTS

| | | | |
|---|---|---|---|
| 1,066,201 | 7/1913 | Fulper | 15/322 |
| 1,661,480 | 3/1928 | Keefer | 15/321 |
| 2,056,850 | 10/1936 | Goughnour | 15/410 X |
| 2,239,183 | 4/1941 | Willard | 15/322 |
| 2,843,866 | 7/1958 | Hancock | 15/321 X |
| 3,591,889 | 7/1971 | Wisner | 15/322 X |
| 4,153,968 | 5/1979 | Perkins | 15/321 |
| 4,270,238 | 6/1981 | Shallenberg et al. | 15/321 |
| 4,455,705 | 6/1984 | Graham | 15/244.2 X |
| 5,134,748 | 8/1992 | Lynn | 15/322 |

FOREIGN PATENT DOCUMENTS

| | | | |
|---|---|---|---|
| 449826 | 3/1913 | France | 15/321 |

*Primary Examiner*—Chris K. Moore

*Attorney, Agent, or Firm*—Charles W. McHugh

[57] ABSTRACT

An apparatus having utility for cleaning large, non-horizontal surfaces such as walls. A generally planar head is adapted to be oriented in a generally vertical manner during use, such that it will have a top, bottom, two sides, and front and rear surfaces. A fibrous pad is sized to cover a substantial portion of the front surface of the head. The pad is selectively removable from the head; but during use the pad is firmly held against the friction forces that are imposed on it by moving the head across the surface being cleaned. A plurality of reservoirs, a conduit, and a pump are provided for supplying a selected cleaning or rinsing liquid at a controlled rate to the top of the head. A low-pressure chamber adjacent the rear of the head is used to collect arty liquid that: has passed through the fibrous pad. A resilient seal around the sides and the bottom of the head is effective to inhibit the leakage of liquid from around the boundaries of the head for as long as the head is maintained upright and as long as a pressure lower than atmospheric is maintained in the chamber. An elongated handle is used by an operator to support the head during cleaning. An open-top tub with supporting casters is used to support and transport the apparatus at a job site.

3 Claims, 3 Drawing Sheets

WASHING APPARATUS FOR WALLS AND OTHER NON-HORIZONTAL SURFACES

BACKGROUND OF THE INVENTION

This invention relates generally to the mechanical washing of the walls of buildings, generally vertical members, and similar non-horizontal surfaces; more specifically, it relates to an apparatus for washing the interior walls of structures, where it is not possible to ignore the wash water that might collect on the floor. The apparatus is particularly adapted for cleaning walls that have been covered with washable coverings such as vinyl plastic materials and the like.

There are numerous instances in which the interior walls of buildings must be periodically cleaned, both to foster a like-new appearance and to promote a clean environment. To make such cleaning an easier job, one of the materials that is routinely applied to walls is a water-proof coveting of vinyl plastic. Vinyl wall coverings are widely used in hospitals, schools, food-serving areas, restrooms and high-traffic hallways and the like, in order that cleaning them can be routinely accomplished with water and detergents. But while the water-proof nature of vinyl wall coverings has provided distinct advantages over old-fashioned painted surfaces the manner of cleaning such wall surfaces has remained somewhat antiquated. Indeed, many walls are still being manually washed with buckets of water and detergent, using sponges and rags to apply both cleaning solutions and rinse water, with dry drop cloths being placed on the floor to preclude excess liquids from accumulating on flooring. Therefore, there has remained a need for a way to more efficiently clean wall coverings, painted walls and the like that have a generally vertical orientation and that are generally impervious to water. It is an object of this invention to provide an apparatus that will satisfy this need.

A further object is to provide a hand-held wand with a relatively long handle, such that a scrubbing pad at the distal end of the handle can be placed in contact with the uppermost and lowermost portions of a wall without requiring excessive movement by a person holding the handle.

One more object is to provide an apparatus that permits rapid switching between a washing compound that may contain water and one or more cleaning agents—and a rinsing compound that may contain only clean water.

Another object is to provide a cleaning apparatus that is conducive to the use of cleaning liquids, including petroleum-based solvents, that might not normally be used if there were a significant risk of contact with human skin.

These and other objects will be apparent from a reading of the specification that follows, with appropriate reference to the figures of the drawing that are attached hereto.

BRIEF DESCRIPTION OF THE INVENTION

Figure 1:
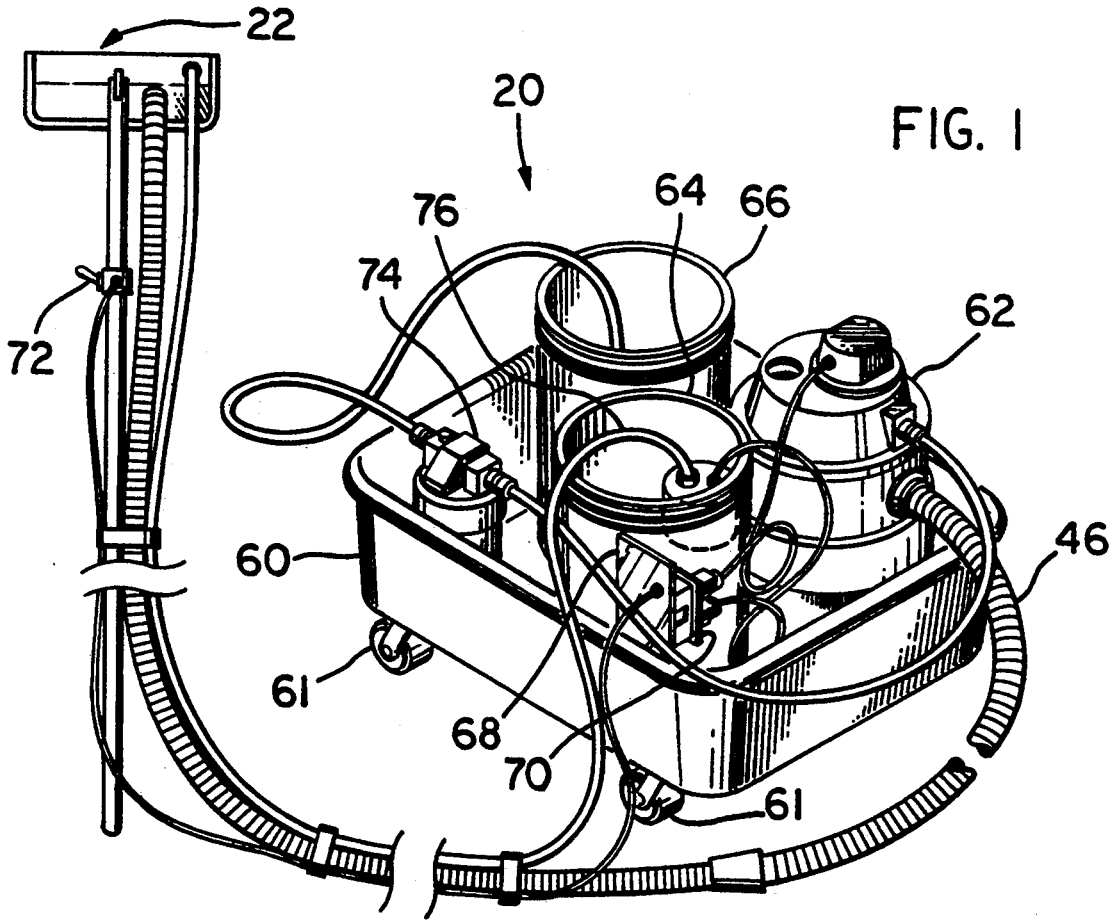
FIG. 1 is a perspective view of an exemplary apparatus in accordance with the invention, showing many of the major components of a total cleaning apparatus.
Figure 1A:
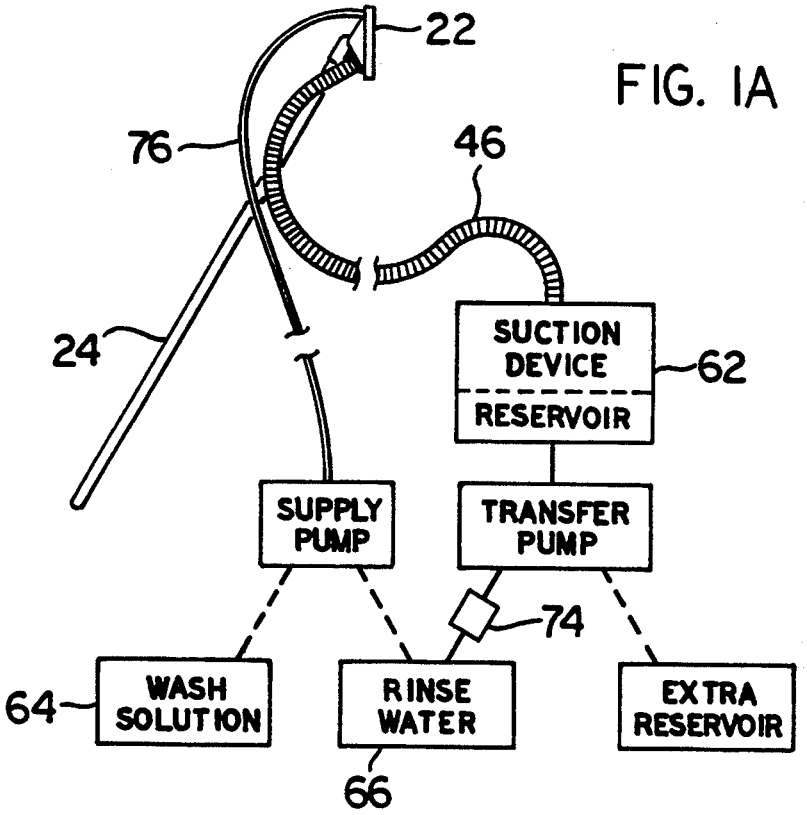
FIG. 1A is a schematic drawing of the major elements that are shown in FIG. 1.

In brief, the invention includes a light-weight, wand-like element that is adapted to be manually moved across a wall or similar non-horizontal surface. The wand is connected through flexible tribes to reservoirs mounted on a dolly or similar platform that is rendered mobile by virtue of casters or wheels. There are preferably three reservoirs: the first reservoir contains a washing or cleaning solution, usually a mixture of water and liquid soap or the like; a second reservoir holds fresh water that can be used for rinsing purposes; and the third is adapted to receive and store used liquids. Because of the potential of some accidental spillage of liquids from one or more of the reservoirs, it is preferred that the dolly be integral with or attached to a shallow tub. Indeed, if the structural characteristics of the tub are adequate, the desired casters or wheels can advantageously be attached directly to the bottom of the tub.

At the distal end of the wand is special head that has a forwardly facing surface to which a fibrous pad is removably attached. The fibrous pad permits mechanical agitation to be applied to a soiled surface when an operator moves the wand-like element over the surface and applies a gentle force through the pad. The back of the head has a chamber that is sealable, and the back wall of the chamber has openings which connect the interior to a source of low pressure, such as a conventional vacuum cleaner. A plurality of small openings near the bottom of the chamber provide a path of communication between the face of the head (behind the fibrous pad) and the chamber interior. The result is that water and cleaning liquids on the front face of the head can be drawn through the small openings into a low pressure chamber on the back side of the head. A flexible hose is connected at one of its ends to the chamber, and is connected at its other end to a suction device (such as a vacuum cleaner) on the dolly; the hose serves as a conduit to remove the accumulated liquids from the head and deliver them to one of the reservoirs.

To facilitate the accumulation of cleaning and rinsing liquids on the front face of the head, and to preclude those liquids from running down a wall or other non-horizontal surface that is being washed, a resilient seal is placed around some, but not all, edges of the head. With the head oriented upright, as if it was ready to be placed against a generally vertical wall, the front face of the head may be considered to have a top, a bottom, and two spaced sides. The three edges around the bottom and the two sides of such a front face are covered with the resilient seal, so as to form a U-shaped lip that accumulates the cleaning and/or rinsing liquids after they have done their work.

Mounted adjacent the top of the front face is a manifold-like element in the form of a tube having downwardly facing openings that serve as nozzles to project liquids downwardly—toward the fibrous pad that is mounted at the front of the head. Thus, a fresh cleaning solution can be pumped from its reservoir to the top of the head and projected downwardly onto a fibrous pad. The cleaning solution will flow downward (by gravity) through the pad as it is moved across the wall, adding the effect of a cleaning solution to the scrubbing action imparted to the wall by the operator-held wand. The cleaning solution accumulates in the bottom of the U-shaped region formed by the resilient seal until the low pressure in the chamber draws the liquid into the rear of the head. The accumulated liquid is then pulled back to the dolly by a wet/dry vacuum cleaner or the like, where the liquid is captured in a reservoir. After an appropriate amount of washing and scrubbing has been accomplished, the operator can shut off the supply of cleaning liquid and switch to a fresh-water rinse—which is dispensed through the same wand and head, and accumulated with the same suction device. At a convenient time, the used wash and rinse water may be filtered in order to trap dirt and non-soluble particles; the filtered water will usually be clean enough that it can be recycled as a part of a solution that is applied to a different section of a wall that is to be cleaned.

DETAILED DESCRIPTION OF A PREFERRED EMBODIMENT OF THE INVENTION

Referring initially to FIG. 1, an apparatus 20 in accordance with this invention includes a head 22 mounted at the distal end of a wand-like element 24 The head 22 is preferably rectangular in shape, having long sides of about nine inches and short sides of about four inches; hence the head will have a frontal area of about 36 square inches. The head 22 is normally oriented so that its longer sides are horizontal when the head is manually held in its operative position (which will be generally vertical when the member being cleaned is vertical). Thus, one of the long sides may be be called the top, and the other long side may be referred to as the bottom. A commercially available head that may be modified to be useful in this invention is a scrub pad holder manufactured by TU-Way Products Division of TU-WAY American Group in Rockford, Ohio; such a holder is reportedly made of DuPont's Zytel nylon and is serviceable with a wide variety of cleaning solutions. One desirable characteristic of such a holder is that it includes an integral apparatus that functions like a universal joint. Using a TU-WAY scrub pad holder, the operator will be able to manipulate the head up, down and sideways over a section of wall in front of the operator.

The wand-like element 24 will typically have a length of about 50 inches long, so that a person at least five foot tall can readily place the head 22 high enough to reach the top of a wall that is ten feet high. To ensure that the wand 24 and the head 22 will not be unreasonably tiring for an operator to maneuver for extended periods of time, the wand is preferably no more than about one-half pound in weight, and the head 22 ideally weighs no more than about 1 and ½ pounds. With hoses (to be described) that are full of liquid, the total weight being maneuvered by an operator will usually be less than about 3 pounds. Of course, a dolly and its reservoirs of liquid and the pumps, filters, etc., will typically weigh on the order of 75 pounds; but they arc adequately supported by large casters on the dolly. Casters at least as large as three inches in diameter make it relatively easy to pull the entire assembly around from room to room on a carpet or a hard surface.

Figure 3:
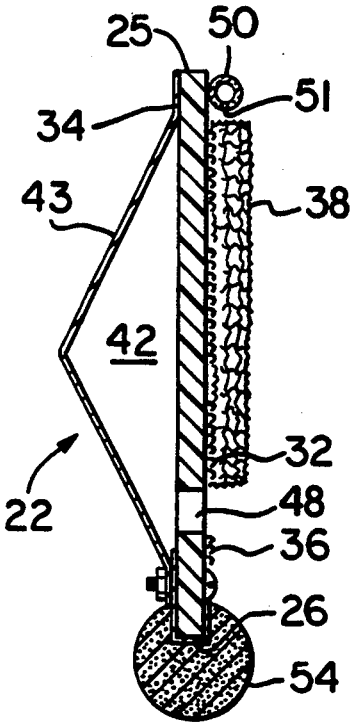
FIG. 3 is a cross-sectional end view of the cleaning head, taken through the plane represented by ther lines 3—3 in FIG. 2.
Figure 6:
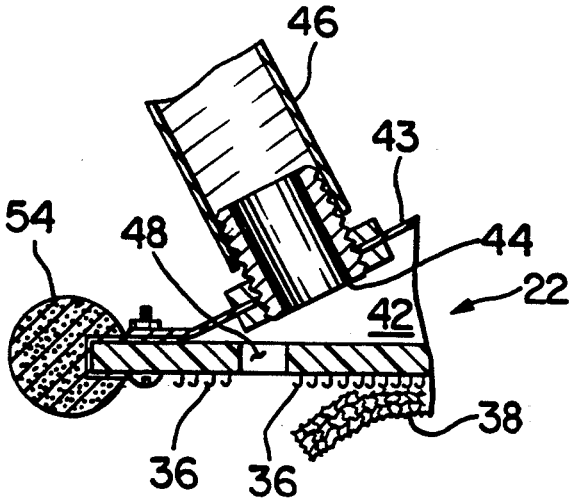
FIG. 6 is an enlarged, fragmentary, cross-sectional view of the lower corner of an exemplary cleaning head—with a fibrous pad being shown partially installed (and partially removed) from the work-contacting face of the cleaning head.
Figure 2:
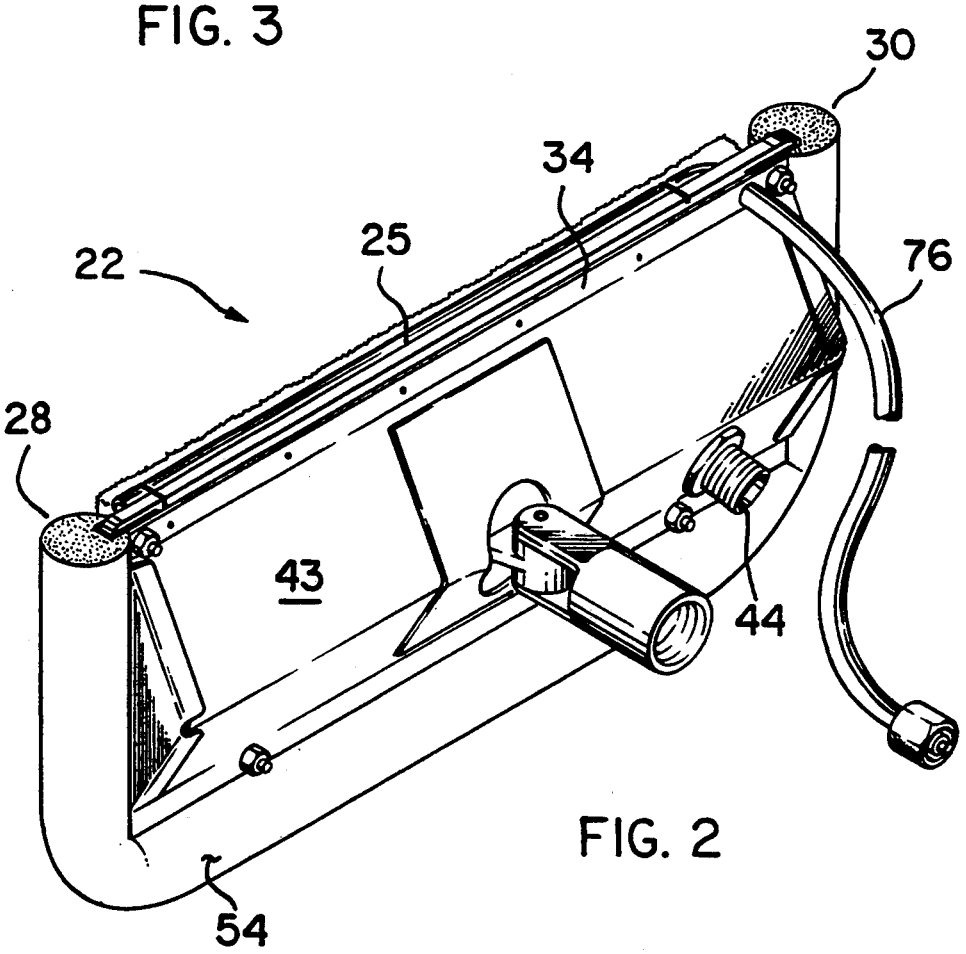
FIG. 2 is a perspective view of a preferred cleaning head that is adapted to be affixed to the distal end of an elongated handle.
Figure 4:
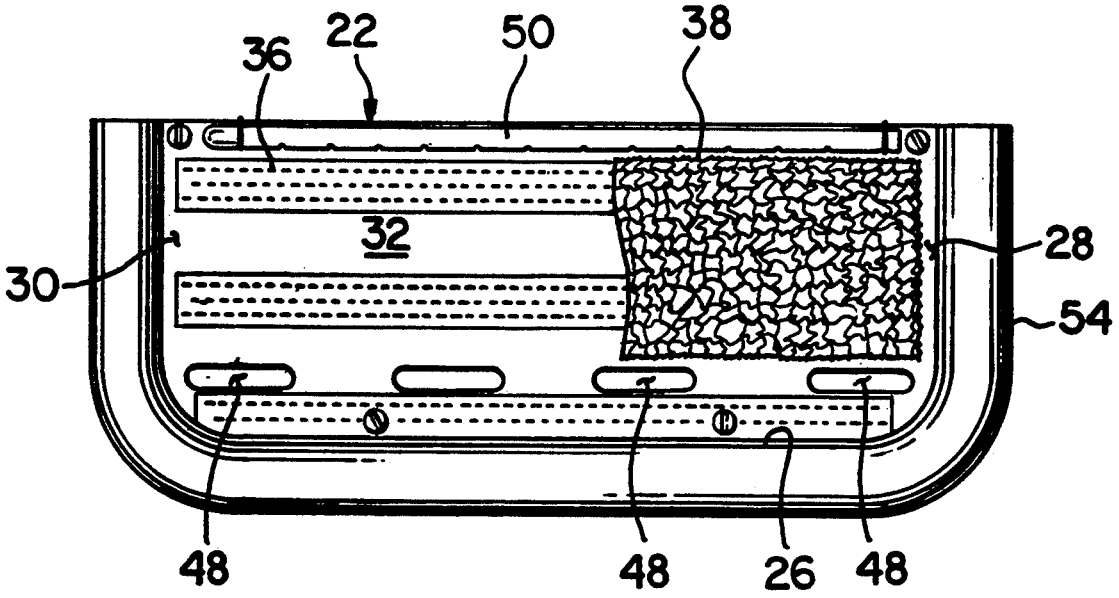
FIG. 4 is a front elevational view of the cleaning head shown in FIG. 2.
Figure 5:
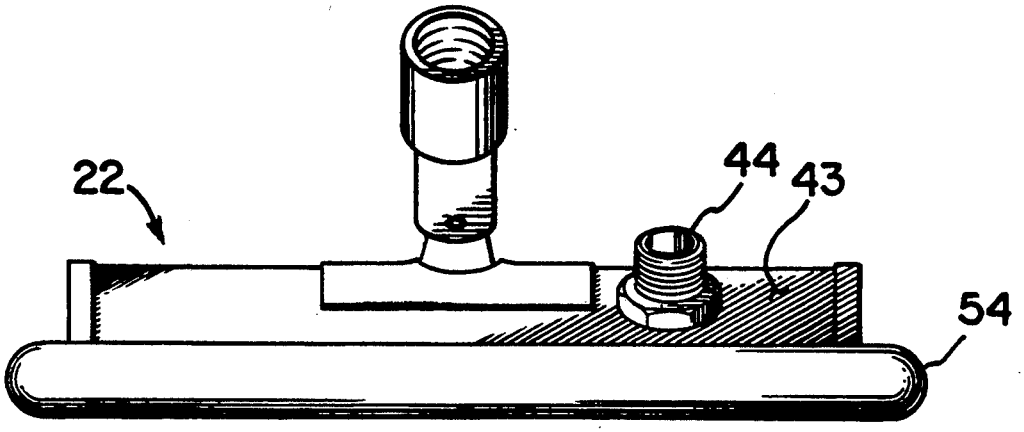
FIG. 5 is a bottom edge view of the cleaning head shown in FIG. 2.

Referring next to FIGS. 2 and 3, the head 22 is usually oriented in a non-horizontal manner when it is used, and it is illustrated in this particular view as being generally vertical. As such, the head 22 may be described as having a top 25, a bottom 26, a left side 28 and a right side 30. The head 22 also has a front surface 32 that will be oriented toward a surface that is to be cleaned, and a rear surface 34 that faces away from the surface to be cleaned. The front surface 32 is generally planar, and it has a plurality of small protruding hooks or knobs 36 that are effective to releasably connect a fibrous pad 38 to the head 22. The small hooks 36 may be thought of as being analogous to the hooks of hook and loop fasteners that have been widely sold under the Velcro brand. The hooks 36 may be integrally formed with a head 22 if the head is molded from a relatively stiff plastic material; or, the hooks may be secured as a strip to a smooth face in the same way that Velcro-brand "hooks" are sometimes secured to rigid surfaces. Whether integrally molded with or subsequently secured to the front face 32, the hooks 36 constitute a means for connecting a fibrous pad to the head 22 in such a way that the pad can be selectively removed and cleaned or replaced. The head/pad connection must be a strong one, however, in order to resist the friction forces that are imposed on the pad as it is manually moved across a surface that is being cleaned. Fortunately, the synthetic fibrous pads that are widely available at janitorial supply stores have more structural integrity than natural sponges and marine products; so maintaining a dependable connection between the head and a fibrous pad has not been found to be a problem. Spaced from the rear surface 34 is a non-planar, rigid wall 40 that is sealed around its periphery to define a chamber 42 that is capable of being placed at a pressure lower than atmospheric. The chamber 42, also sometimes called a vacuum chamber, is advantageously formed by placing a V-shaped piece of structural material (like sheet metal) behind the front surface 32 so that the chamber is juxtaposed with at least two-thirds, and preferably about 90 percent, of the area of the front surface. As will be explained subsequently, the V-shaped wall 43 of the chamber 42 may serve as the anchor point for the wand handle, so it should be made of sturdy material. But if the handle is anchored to the front wall of the head 22, a flexible seal must be provided between wall 43 and the wand handle, so that a suitable vacuum can be established and maintained in the chamber 42, even when the handle is being swiveled with respect to the front wall. Galvanized sheet metal, preferably 24 gauge, has been found to make a suitable rear wall 43.

Protruding rearwardly of the wall 43 is a nipple 44 having external threads that are adapted to be engaged by the end of a vacuum hose 46. The preferred manner of providing a nipple 44 is to utilize a ¾ inch all-thread nipple of the kind that is commonly used in securing metallic tubing or electrical conduit to junction boxes and the like. A pair of self-locking star nuts, one on the inside of the chamber and the other on the outside, can securely hold a nipple 44 in place on the back of the chamber. And a ¾ inch nipple 44 is ideally sized to mate with a light-weight hose that will serve as the vacuum hose for the system. A ¾ inch smooth-bore flexible hose of the type that frequently used as a water-supply hose in recreation vehicles is particularly advantageous. Such a hose is available from Smooth-Bor Plastics of Laguna Hills, California.

The head 22 also has a plurality of small openings that extend from the front surface 32 to the rear surface-at locations such that the openings extend into the chamber 42. One of the slot-shaped openings 48 is shown in FIG. 3, and the other openings are similarly located near the bottom of the head 22 and below the fibrous pad that is affixed to the front face 32. The plurality of openings 48 provide a passageway for any liquids that may be present on the lace of the head 22—such that the liquids may be drawn rearwardly to a low-pressure region within the chamber 42. The area of the slot-shaped openings 48 should be ample to assure a free flow of air (and liquid) from the front of the head 22 to the rear thereof. A total of about four square inches for the openings 48, evenly distributed across the bottom of a nine-inch wide head 22, has been found to be satisfactory.

At the top of the front surface 32 is a tube 50 having a relatively small diameter. e.g., 3/16ths inch, that is placed in communication with a selected one of the reservoirs that are carried by the dolly. The tube 50 has a plurality of small holes 51 which are oriented downwardly toward the fibrous pad 38. The tube 50 and its discharge holes 51 function as a manifold to bathe the pad 38 with any liquid that is admitted to the tube. During a cleaning cycle, the liquid will usually be a soapy solution created by adding a liquid soap to a quantity of water. If appropriate, a solvent or other liquid may be used, even one that is not normally recommended for contact with human hands. Of course, if a flammable solvent is to be used with the system, then any pumps and the like should utilize explosion- proof motors, etc. During a rinse cycle for typical vinyl wails, the rinsing liquid will usually be clean water or a mixture of water and vinegar. In order to simplify the plumbing of the apparatus, the selection of which liquid to transfer to the tube 50 at any given time is made by simply picking up a submersible pump and moving it from one open-top reservoir to another. Thus, the choice of which liquid to transfer to the head 22 at any given time is made by the operator, who is visually inspecting the cleaning process as it progresses; and actual transfer is accomplished by selectively placing the appropriate reservoir into communication with the head. A submersible pump that has been found to be suitable for this "supply" function is a Little Giant TM Model NK-1 pump manufactured by Little Giant Pump Company of Oklahoma City, Okla.

Around the two sides and the bottom of the head 22 is a resilient seal 54 that is provided to inhibit the leakage of liquids from around the boundaries of the head. For a head 22 that is about nine inches by four inches, an optimum seal of ¾ inch spongy rubber will be about 16 inches long. For as long as the head 22 is maintained upright and as long as a pressure lower than atmospheric is maintained in the chamber 42, the seal 54 will cooperate with a confronting wall to form a collection region for liquids that have passed through the pad 38 and have served their purpose. A suitable material for such a seal 54 is a nitrile-vinyl closed cell rubber extrusion, such as the product offered by Rubatex Corporation of Bedford, Va. under the designation R-1828-H. The compression deflection of this preferred material is about 2.0 to 5.0 pounds per square inch, so it may be aptly described as a relatively "firm" material. It is desirable to be able to replace this seal from time to time as it wears, so it is not permanently affixed to the head 22. Rather, the seal 54 is provided with a recess or groove on what will be the "inner side," and a U-shaped metal core is glued in the recess with an orientation such that the opening of the "U" will face the periphery of the head. The metal core need not be bulky or heavy; in fact, sheet metal having the same strength and stiffness of the metal that is used in 12-ounce beverage cans has been found to be adequate. When the metal core is permanently glued to the seal 54, as with a Scotch-Grip No 1300 rubber and gasket adhesive offered by the 3-M Company, then a few small bolts may be used to hold the metal core (and hence the rubber body) securely to the head 22.

Referring again to FIG. 1, to simplify the manufacture of the apparatus, the preferred dolly 60 is formed by placing casters 61 on the bottom of a large tray-like structure having a generally horizontal floor and peripheral walls that extend upward from the floor for about eight inches or so. The structure may be thought of as a shallow tub, and it is sized so that it could receive all of the liquids that might ever be present at any one time in the various reservoirs. A polypropylene tub manufactured by Lewis Systems of Watertown, Wisconsin and having a Size of 34 inches by 24 inches has been found to be very sturdy; it is large enough to be stable and it would hold about 20 gallons of liquid—if it were ever required to do so. SO if there should ever be a failure of some hose, clamp or fitting, then any resultant liquid that was spilled would be captured by the tub. The tub 60 is also useful to receive and store damp towels or sponges or other cleaning materials that may be useful in a cleaning process. By designing the cleaning apparatus to operate on a modest "batch" concept (using a few gallons of liquid, instead of connecting the head 22 to a faucet that operates with a continuous supply of water), there will never be a situation where a tub 60 cannot contain all of the cleaning liquids that are brought into a given area. Hence, the owner of some fine oriental rugs that cover the floor of a room need never be apprehensive about a catastrophic leak in the system 20. Of course, a system could presumably be designed that is connected to a water faucet and has essentially an unlimited supply of water; the threat that arises from such a system is that a leak could conceivably cause the rugs in a room to be accidentally soaked while the walls are being cleaned. Hence, a small "batch" system is definitely the preferred form of the invention.

Resting in the open-top tub 60 are several items, all of which are readily removable-in order that the tub may be emptied at any selected time and cleaned, etc. An empty tub 60 may also be stored in a closet or other small space if it is turned on its side. Of the selectively removable items, probably the largest will be a wet/dry vacuum cleaner 62; essentially any of the modern vet/dry vacuum cleaners that sold for "handyman" use around a garage or workshop will normally be serviceable. As long as the device will provide a vacuum of about 45 inches of water at the head 22, it will probably work nicely in the system 20. A motor rated at between one and two horsepower will normally provide, an adequate amount of vacuum for the system 20. As will be more clear hereinafter, those vacuum cleaners whose tops are very easy to remove will inevitably be favored over those cleaners those tops come off and go on with more difficulty.

Another large item resting in the tub 60 is an open-top reservoir of liquid that is used as the major cleaning solution. This reservoir, identified by the numeral 64, is preferably about five gallons in size, and is made of a material that will be resistant to all of the liquids that might conceivably be used in cleaning a given surface. A suitable material for the reservoir 64 is polyethylene, and a typical cleaning solution is created by placing about three gallons of warm water in the reservoir, along with about two ounces of liquid soap. Water at about 105° F. is preferred for washing a surface, and the water temperature should not be allowed to exceed 112° F., or the soap will begin to break down. Another reservoir 66 is also resting in the tub 60, and the function of this reservoir is to hold rinse water. The open-top reservoir 66, also having a nominal size of five gallons, will typically be provided with about three gallons of clean water from a community water source or the like. To enhance the rinsing action of water in the reservoir 66, a couple of ounces of vinegar will sometimes be added, because the vinegar helps cut through any residual soap film that may be left on a surface.

Also removably mounted at one edge of the tub 60 is a post 68 upon which is mounted an electrical outlet 70 for distributing electrical power, as required, to the electrically powered devices that are useful in practicing the invention. An extension cord of a suitable length is used to connect the outlet 70 to a conventional 120 volt utility outlet in a building where the cleaning is to be accomplished. In view of the fact that such utility outlets will routinely be available where cleanliness is important, there should be no practical limitation on where the system 20 might be used. Because of the proximity of liquids in the reservoirs, etc., the electrical outlet 70 should be be of the type having ground- fault interrupt protection. Thus, if a short should somehow occur in the electrical circuit, the operator of the cleaning device 20 would be protected against a potentially harmful electrical shock.

The risk of an electrical shock with the system 20 is really not great, however, because only three parts of the system use electrical power: 1) the wet/dry vacuum cleaner; 2) a pump which propels a liquid solution to the surface being cleaned; and 3) a transfer pump that transfers collected liquids from the vacuum cleaner reservoir through a filter to another reservoir for reuse. And all of these three electrical devices are confined to the small area of the tub 60, so there is small risk of any improper placement of any part of the system. The back-and-forth movement of the wand and the physical "action" of the head 22 against a wall are solely functions of hand manipulation, and the only electrical connection to the wand is the two wires that lead to an on/off switch (for the supply pump) that is mounted on the wand—for convenience in controlling the supply of liquids to the head.

Assuming that the user of the system 20 will want to be efficient in the use of liquids that are employed, those liquids that have been removed from the head 22 and drawn into the tank of the vacuum cleaner 62 will need to be filtered before they can be used again. To this end, a filter housing 74 is provided at one side of the tub 60. The inlet for housing 74 is adapted to be placed in communication with a transfer pump, which pump can be simply dropped into the tank of the vacuum cleaner when the top is removed. A suitable "transfer" pump is a Little Giant TM Model No. 1 pump available from Little Giant Pump Company of Oklahoma City, Okla. After all of the original cleaning solution has been sent to the head 22 and subsequently collected in the tank of the vacuum cleaner 62, it can be pumped through a filter and into a convenient reservoir, which could even be the rinse reservoir 66. Of course, the used "rinse" water may also be collected in the tank of the vacuum cleaner, and re-used after it has been filtered. A suitable filter is an Amtek Model CSL water filter, which is customarily sold for under-sink installation in residences. Replacement cartridges are readily available for the Amtek housing 74 for filtering 5, 20 or 30 micron particles out of the water passing through the filter.

Turning next to the operation of the system 20, a person who desires to clean a wall or similar non-horizontal surface will first place the tub 60 near the wall and place in the tub the several devices that will be eventually used. Those devices include a plurality of reservoirs (e.g., reservoirs 64, 66), the wet/dry vacuum cleaner 62, a pump for supplying a liquid to the head 22 a pump for transferring a liquid from one reservoir to another, and the post 68 with its utility outlet 70. The reservoirs are then filled with an appropriate amount of the liquids for the assigned task; and, by way of example, it will be assumed that the liquid in reservoir 64 is warm water and a small quantity of liquid soap. Putting only about three gallons of water in a five-gallon container will more nearly ensure that the tub 60 can be pulled over a floor without causing the water to spill over the sides of the reservoir 64. An electrical extension cord is then plugged in to a convenient outlet and connected with outlet 70. One of the scrub pads 38 is then placed on the front face of the head 22, where it covers a substantial portion of the front face. The various tubes and conduits are then checked for the integrity of their connections by placing the wand 24 so that the head 22 is directly over the open top of reservoir 64. Turning the single pole, double throw switch 72 to its ON position will cause the supply pump to begin to propel the cleaning solution in reservoir 64 through conduit 76 to the head 22; the cleaning solution then passes through tube 50 and exits through holes 51. If the supply pump is capable of pumping more liquid than is needed, a flow restrictor is used to cut back the flow of liquid to a preferred flow rate of about one-half pint per minute. (A Little Giant TM Model 1 submersible pump provides enough pumping capacity that it will normally need to be restricted in its function of transferring liquid from one reservoir to another.) When it has been determined that the cleaning solution is flowing through the system with no leaks, then the switch 72 is turned OFF and the tub 60 is moved to a position near the first section of wall that is to be cleaned.

Placing the head 22 against the wall and turning the vacuum cleaner ON then prepares the device for service. The supply pump is then turned ON and the cleaning solution will begin to spurt onto the top of scrub pad 38. A Little Giant TM Model NK-1 pump will supply water to a height of about ten feet, which will be enough for most internal cleaning jobs. Manually moving the wand 24 up and down and sideways over a section of wall will cause the pad 38 to knock loose whatever dirt has accumulated on the wall. The loosened dirt will be sucked through the holes 48 into the low-pressure chamber 42, along with the cleaning liquid that has passed completely through the pad 38. It is not necessary to leave the supply pump ON at all times; one reason that the switch 72 is located on the wand is so that the pump may be selectively turned OFF while scrubbing is taking place. The judgment of the operator is relied on to establish how well the cleaning action is taking place and how to balance the need for cleaning liquid and manual scrubbing. Used cleaning liquid accumulates first within the U-shaped region defined by the seal 54, and it is then pulled through vacuum hose 46 into the tank of the vacuum cleaner 62, so that no liquid drains off the wall onto the floor. After a few feet of wall have been manually scrubbed with the pad 38, the system is turned OFF and a fresh, clean pad 38 is put on the front face of the head 22. The supply pump is then lifted out of the reservoir of cleaning liquid and placed into the open top of the reservoir 66, so that the same "supply" pump can now direct a flow of rinsing liquid to the head. The vacuum cleaner 62 is again activated, and the head 22 is again moved over the area that has just been washed. As with the wash solution, the rinse water is sucked into the vacuum cleaner tank so that it never reaches the floor. If desired, dry rags may be used to rub down the rinsed wall, to remove any water spots that might adversely affect the final appearance of the wall.

During the step of cleaning a wall, the fibrous pad 38 will typically protrude outwardly from the front face of the head 22 for a slight distance, e.g., ⅜ inch. The pad 38 will also protrude outwardly with respect to the rubber seal 54. Hence, the pad 38 will have to be compressed in order to establish the "cupping" action of the seal in preventing liquids from draining downwardly to a floor. But while the pad 38 experiences most of the wear and abuse as a wall is cleaned, it is true that the rubber seal will eventually experience sufficient wear that it no longer does a good job in preventing leakage. When the time comes to replace the seal 54, a few bolts that protrude through the head near the outer edges thereof are simply removed, a new seal is put in position, and the fastening bolts are replaced. The cleaning head may thereby be returned to a like-new condition.

Whenever it is desired, the liquids that have been accumulated in the vacuum cleaner tank may be transferred to another reservoir, or sent through the filter to remove whatever impurities are not wanted. This is readily accomplished by simply taking the top off the vacuum cleaner tank and dropping a submersible pump into the tank. Using at least a small amount of recycling of used liquids, it is possible to achieve dramatic savings in consumed water. Based on preliminary testing of a system 20, it is possible to clean walls with about 1/20 of the amount of water that is required with the old fashioned technique of using water buckets and washing a wall by hand with sponges and the like. Hence, there are savings in water usage as well as minimizing, if not completely eliminating, the risk of water damage to floors and surrounding structures.

While only a preferred embodiment of the invention has been disclosed herein in great detail, it should be apparent to those skilled in the art that modifications and deviations could be made in the various structures and elements that have been described—without departing from the essence of the disclosed invention. Hence, it should be understood that the invention should be measured only by the scope of the attached claims.

What is claimed is:

1. An apparatus having utility for cleaning large, non-horizontal surfaces such as walls, comprising:

a. a head adapted to be oriented during use in a generally vertical mode, such that it will have a top and a bottom and two sides, and the head also having a generally planar front surface that is oriented upright and juxtaposed with a non-horizontal surface such as a wall that is to be cleaned, and the head having a rear surface that is oriented away from the surface that is to be cleaned;

b. a fibrous pad that is sized to cover at least a substantial portion of the front surface of the head;

c. means for removably connecting said fibrous pad to the front surface of the head, and for holding the pad against whatever friction forces are imposed on the pad by the act of manually moving the head across the surface that is to be cleaned;

d. means for supplying a selected liquid at a controlled rate to the top of the head, such that the liquid will flow downward into the fibrous pad when the head is held so that its front face is generally vertical, said means including a plurality of reservoirs, a conduit, and a pump, and each of the reservoirs being adapted to contain a liquid that is useful in the cleaning of a generally vertical surface such as a wall;

f. a chamber sealingly mounted on the head and adjacent the rear of the head, and further including a plurality of openings extending from the front of the head to the rear thereof, said opening being located below the fibrous pad and providing communication between the front of the head and the chamber, whereby any liquid that has passed through the fibrous pad will be drawn through the plurality of openings and into the chamber when the chamber is at a pressure lower than atmospheric;

g. means for selectively establishing a pressure in the chamber that is lower than atmospheric;

h. a resilient seal around the sides and the bottom of the head, said seal being effective to inhibit the leakage of liquid from around the boundaries of the head for as long as the head is maintained upright and a pressure lower than atmospheric is maintained in the chamber;

i. means at the top of the head for admitting a significant quantity of air to the interior of the head, said air also being drawn into the chamber along with the liquid when the chamber is at a pressure that is lower than atmospheric;

j. an elongated handle; and k. means including a swivel joint for connecting the elongated handle to the rear of the head, whereby an operator can grasp a handle and manipulate the head up and down and sideways with respect to a surface to be cleaned at the same time that a selected liquid is being passed through the conduit; and l. wherein the weight of the head, the fibrous pad, the handle, the resilient seal and the conduit is about three pounds.

2. An apparatus having utility for cleaning large, non-horizontal surfaces such as walls, comprising:

a. a head adapted to be oriented during use in a generally vertical mode, such that it will have a top and a bottom and two sides, and the head also having a generally planar front surface that is adapted to be juxtaposed with a non-horizontal surface that is to be cleaned, and a rear surface that is oriented away from the surface that is to be cleaned;

b. a fibrous pad that is sized to cover a substantial portion of the front surface of the head;

c. means for removably connecting said fibrous pad to the front surface of the head and for holding the pad against whatever friction forces as are imposed on the pad by moving the head across the surface that is to be cleaned;

d. means for supplying a selected liquid at a controlled rate and a relatively low pressure to the top of the head, such that the liquid will flow downward onto the fibrous pad when the head is held against a generally vertical surface, and said means including a plurality of reservoirs, a conduit, and a pump, and each of the reservoirs being adapted to contain a liquid that is useful in the cleaning of a generally vertical surface such as a wall;

f. a chamber sealingly mounted to the head adjacent the rear thereof, and further including a plurality of openings extending from the front of the head to the rear thereof, said opening being located below the fibrous pad and providing communication between the front of the head and the chamber, whereby any liquid that has passed through the fibrous pad will be drawn through the plurality of openings and into the chamber when the chamber is at a pressure lower than atmospheric;

g. means for selectively establishing a pressure in the chamber that is lower than atmospheric;

h. a resilient seal around the sides and the bottom of the head, said seal being effective to inhibit the leakage of liquid from around the boundaries of the head for as long as the head is maintained upright and a pressure lower than atmospheric is maintained in the chamber, and wherein the resilient seal has a U-shaped metal core that is configured to mate with respective edges of the head, such that the seal is internally reinforced and thereby rendered more durable; and i. means including a swivel joint for connecting the elongated handle to the rear of the head, whereby an operator can grasp a handle and manipulate the head up and down and sideways with respect to a surface to be cleaned at the same time that a selected liquid is being passed through the conduit.

3. The apparatus as claimed in claim 1 wherein said means at the top of the head for admitting a significant quantity of air to the interior of the head constitutes a spatial gap that is coplanar with the resilient seal and located at the top of the head, said spatial gap creating an upwardly open slot for admitting air at the top of the head when the head is pressed against a generally vertical surface that is to be cleaned.

* * * * *